United States Patent [19]

Reale

[11] 4,278,034

[45] Jul. 14, 1981

[54] FURNACE

[76] Inventor: Lucio V. Reale, 1827-46th St., SE., Calgary, Alberta, Canada, T2B 2J9

[21] Appl. No.: 77,961

[22] Filed: Sep. 24, 1979

[51] Int. Cl.[3] ..... F23B 7/00

[52] U.S. Cl. ..... 110/234; 110/251; 110/252

[58] Field of Search ..... 110/235, 243, 244, 248, 110/251, 252, 346, 233, 234; 122/2, 15, 4 D

[56] References Cited

U.S. PATENT DOCUMENTS

| | | | |
|---|---|---|---|
| 537,054 | 4/1895 | Lyons | 110/251 |
| 1,155,492 | 10/1915 | Krenz | 110/252 |
| 1,246,416 | 11/1917 | Gibbs | 110/252 |
| 1,305,710 | 6/1919 | Gibbs | 110/251 |
| 1,468,450 | 9/1923 | Kohn | 110/252 |
| 1,525,076 | 2/1925 | Kener, Jr. | 110/252 |
| 1,674,304 | 6/1928 | Schamberg | 110/252 |
| 1,866,959 | 7/1932 | Wyse | 110/252 |
| 1,947,836 | 2/1934 | Fahlstrom | 110/252 |
| 2,715,881 | 8/1955 | O'Neil | 110/251 |

FOREIGN PATENT DOCUMENTS

| | | | |
|---|---|---|---|
| 137411 | 1/1930 | Switzerland | 110/251 |
| 1180521 | 2/1970 | United Kingdom | 110/251 |

*Primary Examiner*—Henry C. Yuen
*Attorney, Agent, or Firm*—Townsend and Townsend

[57] ABSTRACT

A furnace adapted to burn a low grade, granulated fuel. The furnace has a combustion vessel to receive a fuel and spaced inner and outer walls. A lid is positionable on the top of the combustion vessel and there is an exhaust vent in the lid. A bottom to the combustion vessel. A false bottom to the combustion vessel spaced above the bottom to define a passageway. There is at least one perforate column extending from the bottom through the combustion vessel to adjacent the lid. Air may be fed to the fuel and the burned residue of any fuel can be supported.

5 Claims, 4 Drawing Figures

18
20
42
46
44
38
36
28
10
12
14
16
34
48
40
32
26
24
22
52
50
54

18
20
42
46
44
38
36
28a
10a
12
14
16
34
48
40
30
32
26
24
22
52
50
54

FURNACE

FIELD OF THE INVENTION

This invention relates to a furnace adapted to burn a low grade fuel, particularly low grade granulated fuel.

DESCRIPTION OF PRIOR ART

Furnaces that burn low grade fuels, particularly saw dust, have been known for a long time. Between about 1930 and 1940 they were extensively used, particularly on the west coast of the United States and Canada where large supplies of sawdust were easily available. Generally it was necessary to fill the furnace daily. For example typically the furnace would be filled each evening.

Such prior art furnaces comprised metal containers having a false bottom and provided with a small hole at the center of the false bottom. A suitable pole could be inserted into the opening prior to filling the container with sawdust. Once the furnace was loaded with sawdust the sawdust was compacted. Once compacting was achieved the pole was removed to leave a central hole, or flue, starting at the false bottom and extending the full height of the sawdust.

At the top of the furnace there was an exhaust or chimney and the hole in the centre of the sawdust was aligned with the exhaust or chimney. Air entered the furnace through the false bottom. For example an opening could be provided in the false bottom to permit air to pass into the furnace.

The central hole was a means of ensuring that air reached all parts of the fuel as it burned. As the combustion proceeded the compacted fuel losts its structrual strength and would then collapse downwardly. The compacted sawdust above would also collapse downwardly and the central hole would thus be destroyed. The affect was to severely limit the efficiency of the combustion and, often, to prevent the combustion completely.

Such furnaces went out of fashion because of the difficulty of obtaining adequate supplies ofsawdust but also because of the relative inefficiency of the furnaces and, in particular, their inability to maintain consistent combustion.

SUMMARY OF THE INVENTION

The present invention seeks to provide a furnace for low grade fuel, for example sawdust, in which the combustion can be controlled easily and, in particular, in which the supply of air to the combusting fuel can be guaranteed.

Accordingly, in a first aspect, there is provided a furnace adapted to burn a low grade, granulated fuel, the furnace comprising: a combustion vessel to receive a fuel and defined by inner and outer walls, spaced from each other; a lid positionable on the top of the combustion vessel; an exhaust vent in the lid; a bottom to the combustion vessel; a false bottom to the combustion vessel spaced above the bottom to define a passageway; at least one perforate column preferably a plurality of perforate columns extending through the combustion vessel whereby air may be fed to the fuel and the burned residue of any fuel can be supported.

In a further aspect there is provided a furnace as defined above but in which there is at least one opening in the false bottom arranged so that it can align with a perforate column positioned in a fuel block during formation of the fuel block. The fuel block is received in the combustion vessel and the columns extend, when the fuel block is in position, through the combustion vessel to adjacent the lid whereby air may be fed to the fuel but the residue of the fuel remains supported.

Preferably the at least one perforate column is a generally central column and a plurality of columns disposed around the central column. The columns may be of metal, asbestoes, ceramic or any such fire-resisting material. In a further embodiment the columns may be of a material that combusts, for example cardboard or hardboard, possibly including a fire-retardant, but at a rate that is slower than the rate of the fuel. Thus, there will always be support for the combusted residue, or ash, while support is needed but the perforate columns will deteriorate into ash sometime after the combustion of the fuel.

In a further aspect there is provided a fuel block formed from a combustible material and including within it at least one perforate column.

In yet a further aspect there is provided a method of combusting a fuel that comprises positioning the fuel in a furnace as defined above igniting the fuel and allowing the combustion to proceed.

The fuel may be selected from sawdust, grains, stalks, waste disposal products, paper and pulp wastes and tar sands.

BRIEF DESCRIPTION OF THE DRAWINGS

Aspects of the invention are illustrated, by way of example, in the accompanying drawings, in which.

DESCRIPTION OF THE PREFERRED EMBODIMENTS

Figure 1:
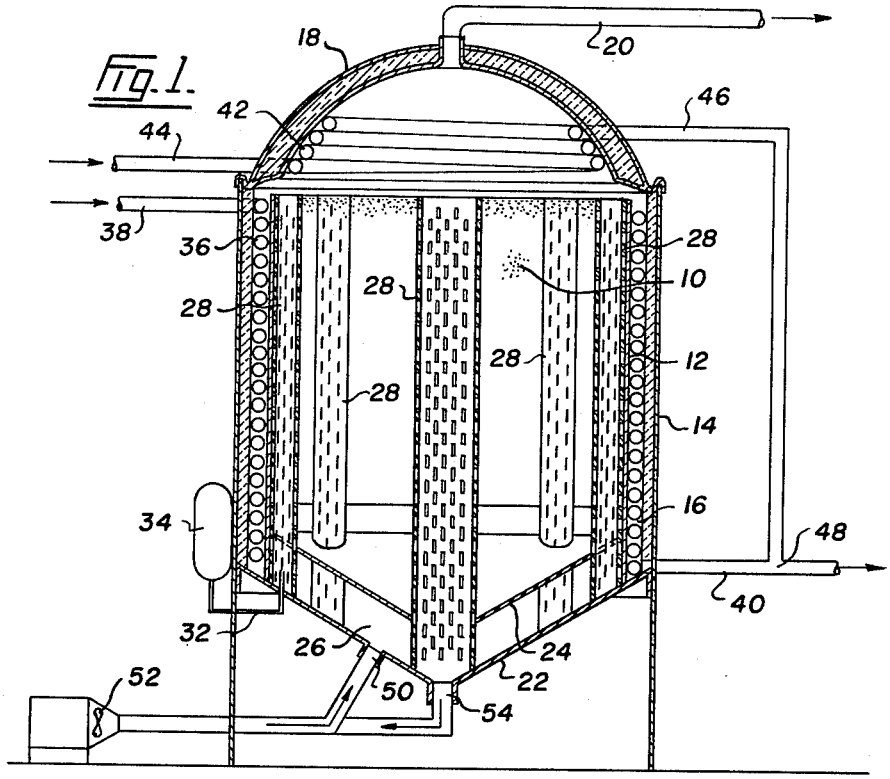
FIG. 1 is a section through a furnace according to the present invention.

Referring to the drawings, FIG. 1 illustrates a furnace to burn a low grade, typically granulated fuel, such as sawdust 10. There is a combustion vessel to receive the fuel 10. The combustion vessel is defined by inner walls 12 and outer walls 14. The inner and outer walls 12 and 14 are spaced from each other to define a passageway 16.

There is a lid 18 positionable on the top of the combustion vessel. An exhaust 20 is positioned in the lid 18.

The combustion vessel is provided with a bottom 22 and with a false bottom 24 spaced from the bottom to define a passageway 26.

In the embodiment of FIG. 1 there are a plurality of perforate columns 28 attached to the bottom 22 of the combustion vessel and extending from the bottom 22, through the combustion vessel to adjacent the lid 18. The arrangement is such that air may be fed into the passageway 26 and upwardly to the fuel 10. The columns 28 then act, by virtue of their perforations, as a means of distributing air throughout the fuel 10 during combustion. As the combustion proceeds the burned residue does not simply collapse but remains supported by the columns 28. An important result of this is that there is always a supply of air to any part of the fuel 10 during combustion.

Figure 3:
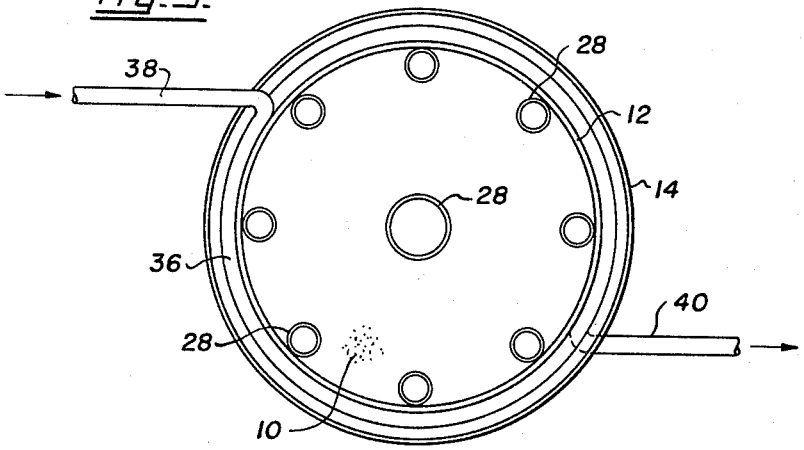
FIG. 3 is a plan view of the typical furnace according to the present invention.

The preferred arrangement for the perforate columns 28 is generally indicated in FIG. 3. The columns 28 comprise a generally central column and a plurality of columns disposed around the central column.

Figure 2:
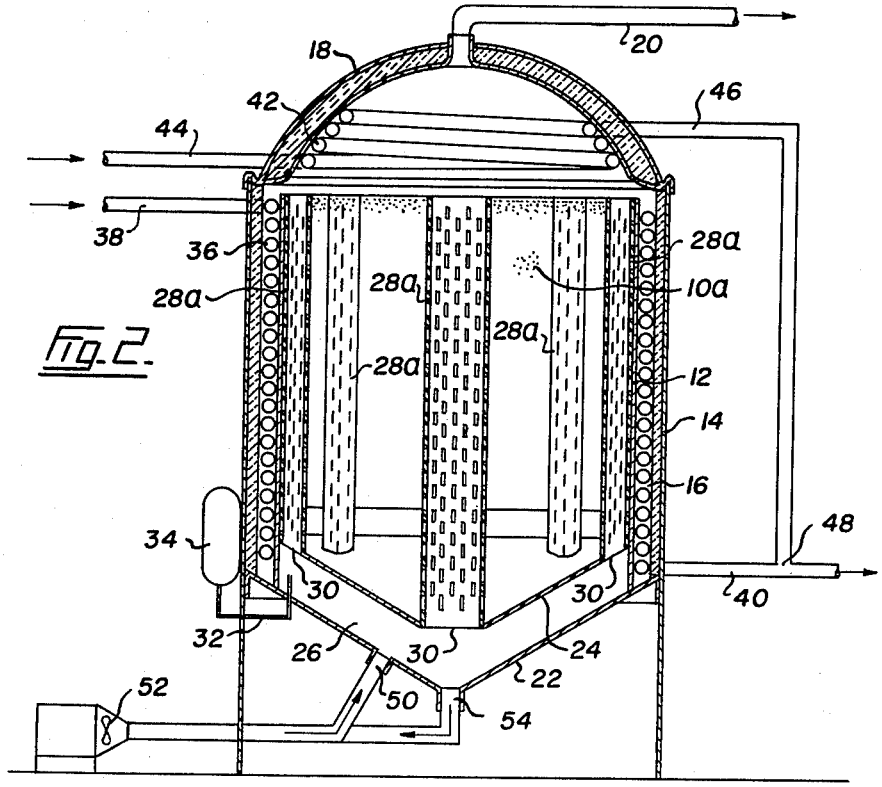
FIG. 2 is a section to a second embodiment of the present invention.

The embodiment of FIG. 2 differs from that of FIG. 1 in that it is adapted to receive a fuel block 10*a* in which perforate columns 28*a* are incorporated during production of the block. In the embodiment of FIG. 2 the false bottom 24 is provided with openings 30 that align with the perforate columns 28*a* positioned in the fuel block 10*a*. That is the openings 30 are arranged in a predetermined pattern which correspond closely to the predetermined pattern of columns 28*a* within the fuel block 10*a*. Again the arrangement of columns 28*a* will be substantially as illustrated in FIG. 3.

In both embodiments of the invention preferably there are means to assist the inital combustion. Typically the means may comprise gas inlets 32, for example from a supply 34 of methane or of natural gas. The gas may be fed through an inlet 32 and into the passageway 26 were it may be ignited. Such an ignition system can be timed to cut out when it is known that ignition will have started or be provided with a manually operable valve so that the gas supply can be cut off when it is observed that the fuel 10 or 10*a* has ignited.

In the interest of general efficiency and of maximum use of the furnace there are provided first pipes 36 to carry liquid, typically water, in passageway 16. Pipes 36 have an inlet 38 for liquid and an outlet 40 for liquid. The liquid to be heated can be used, for example, in a central heating system or may be used to heat hot water for a domestic supply. If the furnace is built on a larger scale then the system can be used to produce steam to operate power generators.

The furnaces may also have second pipes 42 fitted in the lid 18 to carry a liquid. There is an inlet 44 and an outlet 46 for the liquid which may be used precisely as for the liquid heated in the walls. As illustrated in FIGS. 1 and 2 the heated water may be combined at 48. The exhaust 20 can also be used as a source of heat.

There is an inlet 50 in the base 22 for air. It is desirable to include a fan 52 to force air through the inlet to achieve maximum possible combustion.

There is an ash outlet 54 in the bottom 22. As illustrated the bottom 22 is sloped towards the centre and the outlet 54 is positioned at the centre of the base. A vacuum source (not shown) may be connected to the outlet 54 to facilitate withdrawal of ash from the outlet 54. The bottom 22 need not be sloped; it can be flat.

Figure 4:
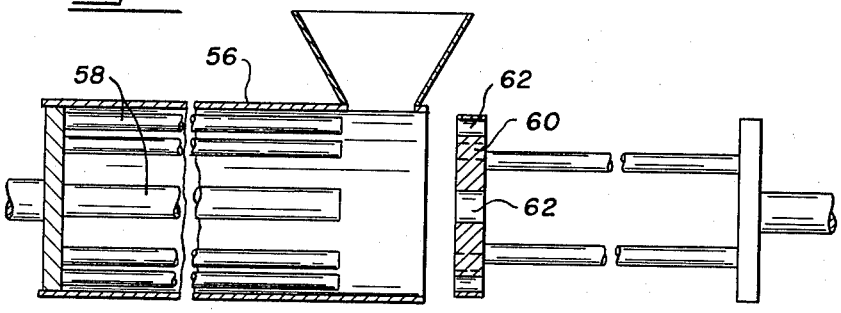
FIG. 4 illustrates an apparatus useful in producing a fuel block for a furnace according to the present invention.

Fuel, particular compacted fuel, for the illustrated furnace may be produced using the apparatus illustrated in FIG. 4. That apparatus comprises a cylinder 56 having formed in it members 58 to correspond with the openings required in the fuel block 10*a* which, of course, correspond with the perforate pipes 28 or openings 30 in the furnace. There is a piston 60 having openings 62 that align with and run on the members 58 in the cylinder 56. To produce a fuel block the required material is introduced into the cylinder 56 and is then compacted using the piston 60. The procedure is continued until a block of the proper dimensions and of the proper degree of compaction is obtained. In the case of a fuel block 10*a* to be used with the furnace illustrated in FIG. 2 the perforate pipes are introduced into the fuel block. The fuel blocks may be wrapped in polyethylene or similar plastic sheet for transporting, for example if they are produced on a large scale at a position separate from the furnace position.

It should be noted that the furnace may be used with uncompacted fuel or any compacting that may be necessary can be carried out in the combustion vessel.

The furnace according to the present invention provides an extremely efficient way of using cheap, easily available fuel, particularly sawdust. By the use of pipes such as 36 and 42 the furnace can be used to heat water; the exhaust pipe 20 can also be used as a source of heat. The use of a vacuum extraction for the ashes greatly facilitates the withdrawal of the ashes and thus reduces the down time of the furnace. Similarly the use of fan 52 in the air inlet system also means that good control of the combustion can be achieved.

The furnace may be made of cast iron, of sheet metal, of concrete or any such fire-resistant material. A refractory lining may be used. As is conventional, at least on industrial furnaces and boilers, a manometer, thermometer and flow meter may be incorporated to measure the various parameters of steam or hot water produced by the furnaces.

The fuel blocks according to the present invention mau be of a wide variety of sizes up to large blocks about twelve feet in diameter by 20 or 25 feet long. The efficiency of the furnace according to the present invention is such that extremely rapid combustion of the fuel takes place giving a rapid and efficient supply of heat, for example sufficient heat to generate steam from water within the pipes 28 and 42.

I claim:

1. A furnace adapted to burn a low grade granulated fuel, the furnace comprising:

a combustion vessel to receive a fuel and defined by inner and outer walls, spaced from each other;

first pipes to carry liquid, the pipes being positioned between the inner and outer walls of the combustion vessel and having an inlet for liquid and an outlet for liquid;

a lid positionable on the top of the combustion vessel;

second pipes to carry a liquid positioned within the lid;

an inlet to feed liquid to the second pipes;

an outlet to take liquid from the second pipes;

an exhaust vent in the lid;

a bottom to the combustion vessel, the bottom being sloped towards the centre;

an inlet in the bottom for air;

a fan, positioned remote from the furnace, to force air through the inlet;

an ash outlet in the base;

extraction means communicating with the ash outlet;

a false bottom to the combustion vessel, spaced above the bottom, to define a passageway;

a gas inlet whereby gas can be introduced into the passageway and ignited as a means of starting combustion of the fuel;

a plurality of perforate columns extending from the bottom through the combustion vessel to adjacent the lid whereby air may be fed to the fuel and the burned residue of any fuel can be supported.

2. A furnace adapted to burn a low grade granulated fuel, the furnace comprising:

a combustion vessel to receive a fuel and defined by inner and outer walls, spaced from each other;

first pipes to carry liquid, the first pipes being positioned between the inner and outer walls of the combustion vessel and having an inlet for liquid and an outlet for liquid;

a lid positionable on the top of the combustion vessel;

second pipes to carry a liquid positioned within the lid;

an inlet for feed liquid to the second pipes;

an outlet to take liquid from the second pipe;

an exhaust vent in the lid;

a bottom to the combustion vessel, the bottom being sloped towards the center;

an inlet in the bottom for air;

a fan, remote from the furnace, to force air through the inlet;

an ash outlet in the base;

extraction means communicating in the ash outlet;

a false bottom to the combustion vessel spaced above the bottom to define a passageway;

a gas inlet whereby gas can be introduced into the passageway and ignited as a means of starting combustion of the fuel;

a plurality of openings in the false bottom arranged so that each opening can align with a perforate column positioned in a fuel block to be received in the combustion vessel, said columns extending, when a fuel block is in position, through a combustion vessel to adjacent a lid whereby air may be fed to the fuel but the residue of burned fuel remains supported.

3. A furnace as claimed in claim 1 or claim 2 in which there are a plurality of perforate columns, comprising a generally central column and a plurality of columns disposed around the central column.

4. A furnace as claimed in claim 1 or 2 in which the columns are of metal.

5. A furnace as claimed in claim 1 or 2 in which the columns are of a material that combusts but at a slower rate than the fuel.

* * * * *